US005485646A

United States Patent [19]

Merritt

[11] Patent Number: 5,485,646

[45] Date of Patent: Jan. 23, 1996

[54] HAIRBRUSH WITH ELECTRONIC STROKE COUNTER

[76] Inventor: Robert L. Merritt, 4274 Catcerrk Rd., Valdosta, Ga. 31602

[21] Appl. No.: 301,076

[22] Filed: Sep. 6, 1994

[51] Int. Cl.[6] ..... A46B 9/04; A46B 7/06

[52] U.S. Cl. ..... 15/105; 15/159.1; 15/172; 15/185; 15/176.1; 377/15; 434/262

[58] Field of Search ..... 15/105, 159.1, 15/160, 167.1, 176.1, 172, 176.6, 185; 377/15, 19, 17; 434/263, 262

[56] References Cited

U.S. PATENT DOCUMENTS

| | | | |
|---|---|---|---|
| 2,981,963 | 5/1961 | Peilet et al. | 15/105 |
| 3,104,056 | 9/1963 | Cross | 15/105 |
| 3,398,421 | 8/1968 | Rashbaum | 15/172 |
| 4,716,614 | 1/1988 | Jones et al. | 15/167.1 |
| 4,833,697 | 5/1989 | Perna et al. | 377/15 |
| 5,331,707 | 7/1994 | Irizarry | 15/167.1 |

FOREIGN PATENT DOCUMENTS

| | | | |
|---|---|---|---|
| 1780500 | 12/1992 | U.S.S.R. | 15/167.1 |
| 2252234 | 5/1992 | United Kingdom | 15/167.1 |

*Primary Examiner*—Gary K. Graham

[57] ABSTRACT

A brush which includes a stroke counting mechanism used to count the number of strokes made in the brushing of hair. The number of strokes is displayed on a digital read out which is mounted to the brush handle for easy reference. The brush can be used as a training aid it assists children in building counting skills.

1 Claim, 3 Drawing Sheets

HAIRBRUSH WITH ELECTRONIC STROKE COUNTER

BACKGROUND OF INVENTION

1. Field of the Invention

This invention relates to hair brushes. More specifically, the present invention relates to a device that counts the number of strokes made while brushing hair.

2. Prior Art

Teaching children to count comes in many forms. By making a daily routine a learning experience, value can be derived. While teaching children to brush their hair they can count the number of strokes, recognize the numbers displayed as a reference, and add additional numbers and again refer to the digital readout for the summation.

There are known devices that use electrical current in hair brushing appliances such as the "Electric Hair brush" of Ergaver et al., U.S. Pat. No. 4,292,986 and the Electric Hair Brush" by J. Tone et al., U.S. Pat. No. 3,427,674, and stroke counting devices such as "Golf Glove With Stroke Counter", by Conley, U.S. Pat. No. 4,922,850.

No device is known, however, that counts the number of strokes made in the brushing of hair.

SUMMARY OF THE INVENTION

The principle object of the digital hair stroke counter brush is to help teach small children to count while practicing hygiene in personal maintenance. As the child brushes their hair they can look at the counter to see how many times they have passed the brush through their hair. This teaches the child to count and reinforces the foundations of hygiene and neat appearances.

It also is also an object of the present invention to provide a device that is of simple, inexpensive construction.

The fore going objects can be accomplished by providing a hair brush which would be constructed in two main bodies, a handle and a base. The handle will embody a digital readout device with battery, electrical current conductive material and electrical contact points. The base will embody electrical current conductive material attached to electrical contact points, with bristles protruding from the bottom of the base. The handle and the base are attached by a flexible material which acts as a spring allowing the electrical contacts to meet as force is applied at the beginning of each stroke which allows current to flow through the circuit (with each flow of electrical current the digital read out device will register a progressive number for each stroke), and then the spring returns to its original configuration as force is eliminated when the stroke ends and electrical conductivity stops as the contact points separate.

DETAILED DESCRIPTION

Figure 1:
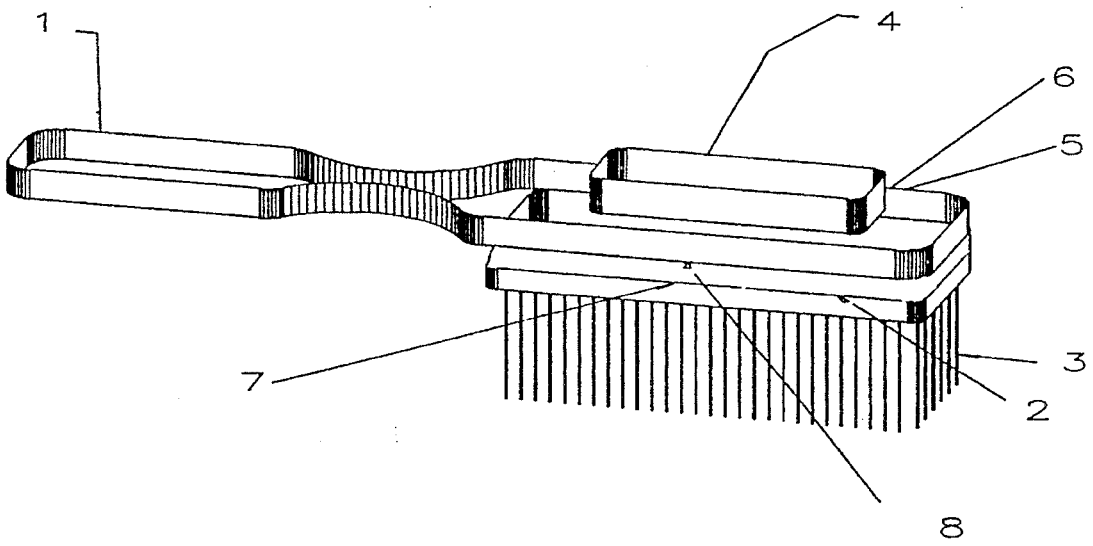
FIG. 1 is a perspective top, right, and front side view of an assembled Digital readout Hair Stroke Counter Brush in accordance with the present invention.
Figure 2:
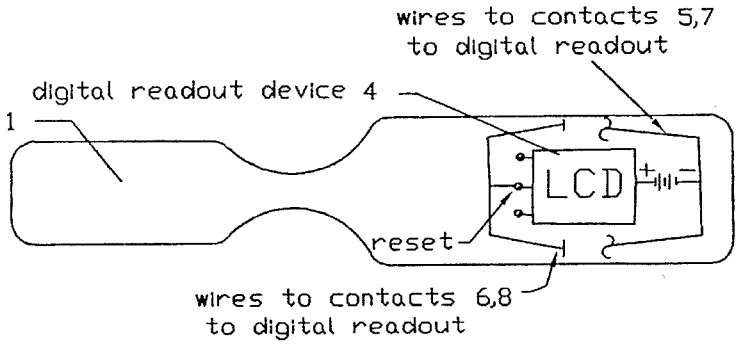
FIG. 2 is a top view of the handle.
Figure 3:
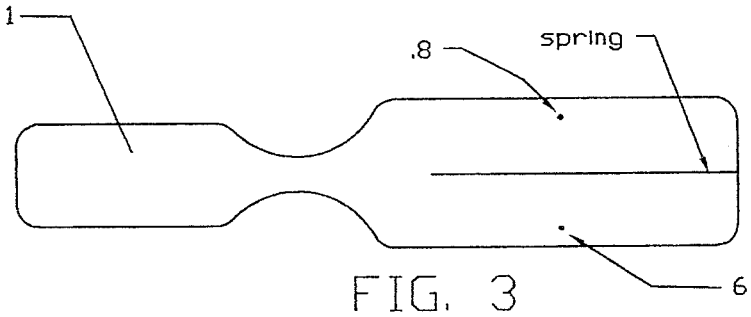
FIG. 3 is bottom view of the handle.
Figure 4:
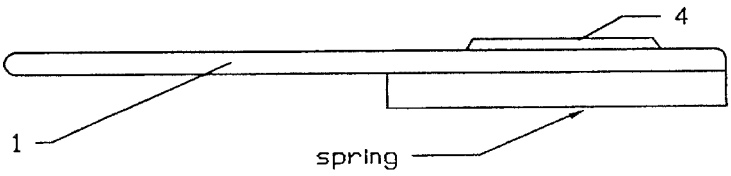
FIG. 4 is a side view of the handle.
Figure 5:
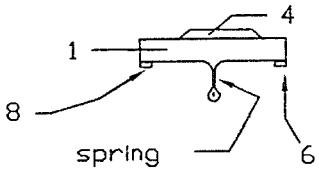
FIG. 5 is a front end view of the handle.
Figure 6:
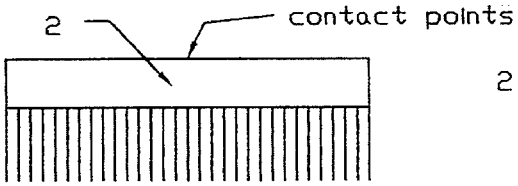
FIG. 6 is a side view of the base.
Figure 7:
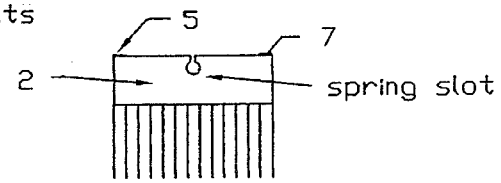
FIG. 7 is a rear end view of the base.
Figure 8:
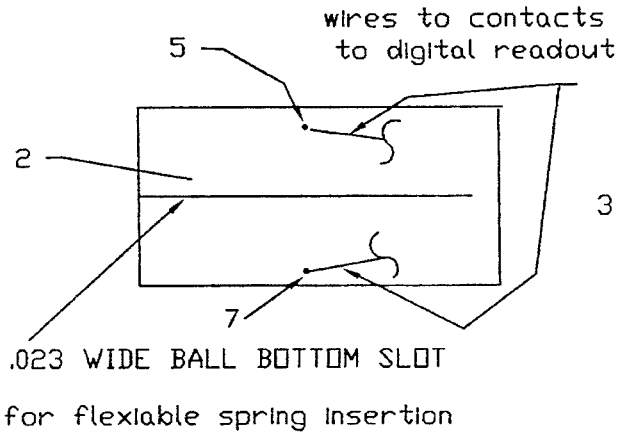
FIG. 8 is a top view of the base.
Figure 9:
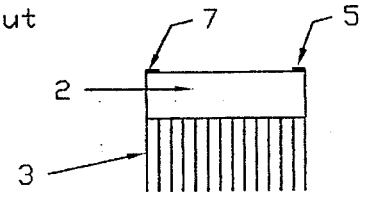
FIG. 9 is the front end view of the base.

As shown in the drawings, the present invention as seen in FIG. 1 includes a flat, elongated brush handle (1), a flat, elongated base (2), bristles (3), digital read out device (4), and contact points (5,7) on the base and 6,8) on the. The brush is assembled to form that shown in FIG. 1 by sliding the base (as seen in FIG. 6, 7, 8, & 9) which includes a slot on a top side thereof (from the FIG. 7 end) onto a thin protrusion spring member extending from the bottomside of the handle (as seen in FIG. 3, 4, & 5) and to the rear which aligns the contact points of the base and the handle where it would be affixed. Electrical conductive material, such as wire, is connected to the conductive contact points which is connected to a digital readout device. The digital read out device 4 is powered by a small dry cell battery which powers the circuit when the electrical contacts are caused to close. The base contact points (via conductive material) are connected to what I theorize to be the negative side of the digital read out device, and the handle contact points are connected to the set data time function control reset button area of the printed circuit board (via conductive material) of the digital read out device, which is affixed on the top side of the handle as seen in FIG. 2. The digital read out device FIG. 1 item 4 will consist of a modified prior art watch calendar device. It will be capable of being reset into a counting mode or reset into a time (hour-minute) function mode by depressing a reset bottom.

The preferred material of the base and handle is plastic media which can be formed through an injection molding processes. The contact points and conductive material could be constructed of copper, aluminum, or other media able to conduct electrical current. The digital readout device would be constructed through printed circuits with a plastic cover enclosing the device. The brush bristles would be formed separately from plastic media or other suitable material, and attached to a bottom side of the base preferably in holes formed therein during the molding process of the base.

I claim:

1. A brush for brushing of hair, said brush comprising:

a flat, elongated handle having opposite ends, first and second opposing sides and first and second opposing edges, said handle having an elongated, flexible spring member substantially parallel therewith and extending laterally from said first side of said handle adjacent one end thereof, said spring member having an enlarged free edge and positioned intermediate said edges, a pair of spaced electrical contacts are mounted on said first side of said handle with said spring member positioned therebetween;

a flat, elongated base having first and second opposing sides and first and second opposing edges, said base having bristles extending from said first side thereof, said base having an elongated slot formed in the second side thereof intermediate said first and second edges of said base, a pair of spaced electrical contacts mounted on said second side of said handle with said slot positioned therebetween, said slot receiving the enlarged free edge of the spring member of said handle to couple the handle and base such that said base can swing relative to said handle in opposing directions during stroking of hair, the electrical contacts of the base being aligned with those of the handle such that upon swinging of the base in each direction, one of the contacts of the base engages one of the contacts of the handle;

an electronic digital read out means having a liquid crystal display mounted on the second side of said handle, said means is electrically coupled via wires to all of said electrical contacts such that as the brush is used to stroke hair, the digital read out means indicates the number of strokes achieved.

* * * * *